United States Patent [19]

Westhead

[11] 4,308,897

[45] Jan. 5, 1982

[54] DRYER FELT WITH ENCAPSULATED, BULKY CENTER YARNS

[75] Inventor: William T. Westhead, Waycross, Ga.

[73] Assignee: Scapa Dryers, Inc., Waycross, Ga.

[21] Appl. No.: 64,365

[22] Filed: Aug. 7, 1979

Related U.S. Application Data

[63] Continuation-in-part of Ser. No. 932,360, Aug. 9, 1978, Pat. No. 4,274,448.

[51] Int. Cl.[3] ..... D03D 15/00

[52] U.S. Cl. ..... 139/383 A; 139/426 R; 139/412; 162/DIG. 1

[58] Field of Search ..... 139/383 R, 383 A, 408, 139/409, 410, 411, 412, 413, 414, 420 R, 426 R, 425 R; 162/348, DIG. 1; 428/280; 57/210, 224, 229

[56] References Cited

U.S. PATENT DOCUMENTS

| | | | |
|---|---|---|---|
| 1,811,573 | 6/1931 | Bacheldor et al. | 139/425 |
| 2,934,097 | 4/1960 | Hindle et al. | 139/383 A |
| 2,936,796 | 5/1960 | Hindle et al. | 139/383 A |
| 3,049,153 | 8/1962 | Jones | 139/426 |
| 3,410,078 | 11/1968 | Freedmann | 57/211 |
| 3,429,354 | 2/1969 | Brooks | 57/210 |
| 3,653,961 | 4/1972 | Lefkowitz | 139/383 |
| 4,024,895 | 5/1977 | Barron | 139/426 R |

*Primary Examiner*—Henry Jaudon
*Attorney, Agent, or Firm*—Fleit & Jacobson

[57] ABSTRACT

A dryer felt comprising a plurality of machine direction and cross machine direction yarns interwoven to provide a multiple-plane fabric having at least a base plane, a top plane and an intermediate plane positioned between the base plane and the top plane. The base plane is defined by a first plurality of cross machine direction yarns, the top plane is defined by a second plurality of the cross machine direction yarns, and the intermediate plane is defined by a third plurality of the cross machine direction yarns. In one embodiment, encapsulated stuffer yarns constituted the third plurality of the cross machine direction yarns. In another embodiment, encapsulated filling yarns constitute the third plurality of the cross machine direction yarns. In all embodiments, each of the encapsulated yarns comprises a straight, twistless monofilament core and a close-fitting encapsulating sheath surrounding the full length of the core.

25 Claims, 5 Drawing Figures

DRYER FELT WITH ENCAPSULATED, BULKY CENTER YARNS

RELATED APPLICATIONS

This Application is a continuation-in-part of co-pending U.S. patent application Ser. No. 932,360, U.S. Pat. No. 4,274,448 filed Aug. 9, 1978.

FIELD OF THE INVENTION

This invention relates to papermaking fabrics, in general, and to dryer felts having improved bulk, in particular.

BACKGROUND OF THE INVENTION

A conventional dryer felt consists of an endless conveyor belt made from a multiple-plane fabric, wherein the various planes can be defined either by different groups of cross machine direction yarns, machine direction yarns or both. The planes, or plies, or layers are united in a binding relationship by a plurality of machine direction yarns. The yarns used to weave the most up-to-date dryer felts are made from synthetic monofilaments such as polyester or polyamide, or synthetic multifilaments, from such materials as polyester, acrylic, polyamide or the aramid fiber group—NOMEX and KEVLAR.

Because some of the synthetic materials are quite expensive, manufacturers are continually seeking to improve dryer felts, both in terms of cost and in terms of dryer felt reliability. Along these lines, it is important in certain dryer felts to maintain low air permeability, and one way of lowering the permeability is to weave more yarns to the inch. This, of course, adds to the cost and weight of the already expensive felts.

In co-pending U.S. Application Ser. No. 932,360 filed Aug. 9, 1978, of which this application is a continuation-in-part, there is disclosed an improved dryer felt which overcomes many of the short comings of the prior art. As disclosed in the co-pending application, the improved dryer felt comprises a plurality of machine direction and cross machine direction yarns interwoven in a binding relationship to provide a multiple-plane fabric having at least a base plane, a top plane and an intermediate plane positioned between the base plane and the top plane. Each of the planes is defined by a different plurality of the cross machine direction yarns. The plurality of the cross machine direction yarns, which define the intermediate plane, are encapsulated yarns so as to provide a soft, bulky intermediate plane. Each of the encapsulated yarns comprises a monofilament core and an encapsulating sheath surrounding the full length of the core. The sheath defines a soft bulky outer surface which, when woven into the fabric, acts to prevent shifting, or migrating of the encapsulated yarns bound into the fabtic by the machine direction yarns. The monofilament core of the encapsulated yarn may comprise either a monofilament fiber, or a bundle of fibers treated with a suitable resin, such as phenolic resin, so that the resin treated bundle acts as a monofilament fiber. The encapsulated yarns reduce permeability while contributing to fabric stability.

Although a fabric made according to the teachings of the co-pending application, exhibit improved strength, stability, and permeability characteristics, it has been found that these characteristics may be further improved by applying the teachings of the present invention.

SUMMARY OF THE INVENTION

The improved dryer felt of the subject invention comprises a plurality of machine direction and cross machine direction yarns interwoven in a binding relationship to provide a multiple-plane fabric having a base plane, a top plane and an intermediate plane positioned between the base plane and the top plane. The base plane is defined by a first plurality of the cross machine direction yarns. The top plane is defined by a second plurality of the cross machine direction yarns, and the intermediate plane is defined by a plurality of bulky encapsulated cross machine direction yarns. In one embodiment, the intermediate plane is defined by a plurality of encapsulated stuffer yarns, and in another embodiment, the intermediate plane is defined by a plurality of encapsulated filling yarns.

Each of the encapsulated yarns comprises a straight, twistless monofilament core and a close-fitting encapsulating sheath surrounding the full length of the core. The monofilament core may comprise either a straight, twistless monofilament fiber, or a bundle of straight, twistless fibers joined together by resin treatment so that the resin treated bundle acts as a monofilament fiber. The sheath defines a soft, bulky outer surface which, when woven into the fabric, acts to prevent shifting, or migrating of the encapsulated yarns used to bind the encapsulated yarn into the fabric.

By using the specific encapsulated yarns to define the intermediate plane, a dryer felt is provided which contains many attributes not heretofore found in prior art dryer felts. By using the bulky encapsulated yarns to define the intermediate plane, the permeability of a given dryer felt may be decreased by a desired amount without adding additional yarns per inch to the woven fabric. Accordingly, the use of the encapsulated yarns permits a dryer felt manufacturer to produce a dryer felt having the same permeability as a prior art dryer felt, but using less yarns per inch, thereby reducing manufacturing costs. At the same time, the bulky encapsulated yarns, because of their bulky sheath are prevented from shifting, thereby rendering a more stable felt. Further, fabric stability is maintained by the straight, twistless monofilament core.

It is, thus, an object of the present invention to provide a dryer felt having a desired permeability, but using less yarn than a comparable prior art dryer felt.

It is another object of the present invention to decrease dryer felt permeability without the addition of further yarns.

It is a further object of the present invention to provide an economical and stable dryer felt having an intermediate plane defined by encapsulated stuffer yarns.

It is still a further object of the present invention to provide an economical and stable dryer felt having an intermediate plane defined by encapsulated filling yarns.

It is yet an object of the present invention to provide a dryer felt having a desired permeability without sacrificing fabric stability.

It is still another object of the present invention to provide a dryer felt having a desired permeability without adversely affecting the overall strength of the fabric.

Other objects and advantages of this invention will further become apparent hereinafter and in the drawings.

DETAILED DESCRIPTION OF THE DRAWINGS

Figure 1A:
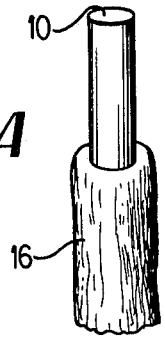
FIGS. 1A and 1B show, in perspective, two embodiments of encapsulated yarns in various stages of assembly.

In describing the preferred embodiments of the invention illustrated in the drawings, specific terminology will be resorted to for the sake of clarity. However, it should be understood that the invention is not to be limited to the specific terms so selected, and it is to be understood that each specific term includes all technical equivalents which operate in a similar manner to accomplish a similar purpose.

Figure 1B:
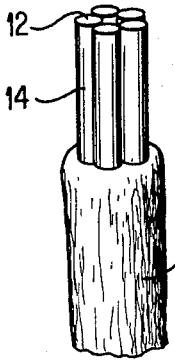

The subject invention will now be described with reference to the drawings, in which FIGS. 1A and 1B illustrate two types of encapsulated yarns. At the heart of the encapsulated yarn is a monofilament core, designated as 10 in FIG. 1A and 12 in FIG. 1B. The monofilament core 10 is a monofilament of a single fiber, whereas the monofilament core 12 is composed of a bundle of synthetic fibers 14, treated with a high temperature resistant resin, such as phenolic resin, to cause the bundle to act as a monofilament fiber in the woven felt.

The fibers constituting the monofilament cores 10 and 12 are preferably made from polyester. However, the fibers can also be of fibers made from polyamides, acrylics, aramids and polyolefins. It is also possible to employ fine wire and/or rubber-type resin treated glass yarns as core materials.

The monofilament core, 10 or 12, is straight and twistless to prevent kinking and to retain maximum resistance to compression without buckling. If the monofilament core exhibits any twist, then it is possible that the core will develop a torque which, in turn, leads to spiraling and compression of the core. Such spiraling and compression may adversely affect fabric stability. As used herein, the term "twist" is defined, according to industry standards, as the number of turns about its axis per unit of length of a yarn or other textile strand. Twist may be expressed as turns per inch (tpi), turns per meter (tpm), or turns per centimeter (tpcm). Thus, a twistless yarn or a yarn with no twist is one that has no turns about its axis per unit of length.

Therefore, the monofilament core 10 comprises a straight, monofilament fiber with no twist, while the monofilament core 12 comprises a bundle of straight monofilament fibers 14 with no twist. Further, the fibers 14 of the core 12 are arranged next to each other and are not joined together by twisting. The bundle of straight, monofilament fibers 14 without twist are then treated with a high temperature resistant resin, such as phenolic resin, to cause the bundle to act as a monofilament fiber. It should be emphasized, that the fibers 14, constituting the monofilament core 12, are treated to make them act like a monofilament fiber.

Each of the monofilament cores 10 and 12 is encapsulated in a close-fitting sheath or sleeve 16 which completely surrounds and covers the core. Sleeve 16 is made from a material producing a soft, bulky texture. Suitable materials are mineral fibers such as asbestos, natural fibers such as cotton or wool, or synthetic fibers such as polyesters, acrylics, polyamides or aramids. In one embodiment, the sleeve is produced from spun staple fibers in sliver, roving or yarn form. In another embodiment, the sleeve is produced by employing a yarn texturising process. In such a process, a yarn comprising a plurality of filaments made from man-made materials which are not originally or inherently crinkled are rendered bulky by causing the filaments to become crinkled. The plurality of filaments of the yarn is made up of a group of more than one substantially continuous filament, or a plurality of such groups of filaments. Such yarns are sometimes referred to in the textile arts as "textured" yarns. In yet another embodiment, the sleeve is produced by employing natural yarns which are originally or inherently crinkled, such as cotton or wool, and which are not inherently crinkled, such as bast fibers.

Figure 2:
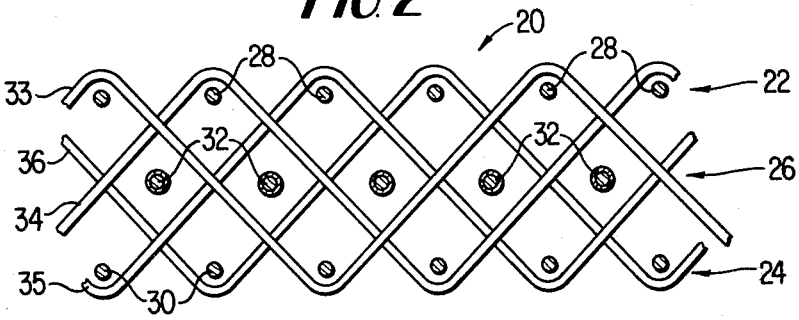
FIG. 2 is a longitudinal section of a duplex weave dryer felt employing the subject invention.

FIG. 2 illustrates a dryer felt embodying the subject invention. The dryer felt, generally designated as 20, is woven into a duplex weave by either the endless or flat weave process. The dryer felt 20 contains three planes: a top plane or top surface 22, a bottom plane or bottom surface 24, and an intermediate plane 26. The top plane, which provides the face of the dryer felt, is defined by a plurality of cross machine direction yarns 28, which are made from a synthetic monofilament, a synthetic multifilament or spun staple fibers (also called spun fiber yarns). The yarn made from the multifilament, or spun staple fibers is preferably stabilized by a resin treatment using, for example, phenolic resin; but this is not essential, and it would not be done with every type of dryer felt. The bottom plane, which provides the back of the dryer felt, is defined by a plurality of cross machine direction yarns 30, which are made from a synthetic monofilament, synthetic multifilaments or spun fiber yarns. The intermediate plane is defined by a plurality of encapsulated stuffer yarns 32. The yarns defining the various planes are united in a binding relationship by machine direction yarns 33 through 36, also made from a synthetic monofilament, synthetic multifilaments or spun fiber yarns. The machine direction yarns 33 through 36 cross each other sufficiently closely together to bind and hold the encapsulated yarns 32. Further, the soft, bulky outer surface of the encapsulated yarns 32 prevents the encapsulated yarns 32 from shifting, thereby rendering a more stable fabric.

In a fabric produced according to the teachings of the subject invention, the monofilament core, 10 or 12, of the encapsulated yarns 32 must be compatible with the remainder of the yarns in the fabric. During weaving, the encapsulated cross machine direction yarns 32 are woven into the fabtic so that they are straight with all crimping taking place in the machine direction yarns 33–36, which are used to bind the encapsulated yarns into the fabric. During subsequent tension and heat setting operations, some of the crimp in the machine direction yarns is transferred to the encapsulated yarns so that the machine direction yarns are less crimped and the encapsulated yarns are moderately crimped.

In order to produce the proper crimp interchange between the machine direction and cross machine direction yarns to give the fabric its proper stability, the diameter of the monofilament core of the encapsulated yarn must be the same or greater than the overall diameter of the other yarns forming the fabric. In addition, the materials used to make the monofilament core of the encapsulated yarn should have the same or greater strength and stability characteristics than the other yarns of the fabric.

The diameter of the monofilament core of the encapsulated yarn, as well as the overall diameter of the other yarns used to produce the fabric, is important for a different reason. Prior to weaving, the various yarns used to produce the fabric are packaged on rolls. As the yarns sit on the package, they take a cold set and are wavy as they are unwound from the package during weaving. If the core diameter is too big, the wave cannot be controlled at weaving, and therefore, especially in the case of the encapsulated yarns, it is difficult to produce a straight yarn in the woven fabric. If the core diameter is too small, then fabric stability is lost.

The diameter of the monofilament core 10 or 12 as well as the overall diameter of the synthetic monofilament, the synthetic multifilament, or the spun fiber yarns used for the remaining yarns in the dryer felt, are typically in the range of about 5 to 50 mils, with a range of about 15 to 35 mils being preferred. It is to be understood that any dryer felt woven in a multi-layer weave can benefit greatly from using the encapsulated stuffer yarns of the subject invention. By adding encapsulated stuffer yarns, stability is enhanced, permeability is reduced, and, hence, the remaining yarns may be woven more loosely without detracting from the effectiveness of the felt.

Figure 3:
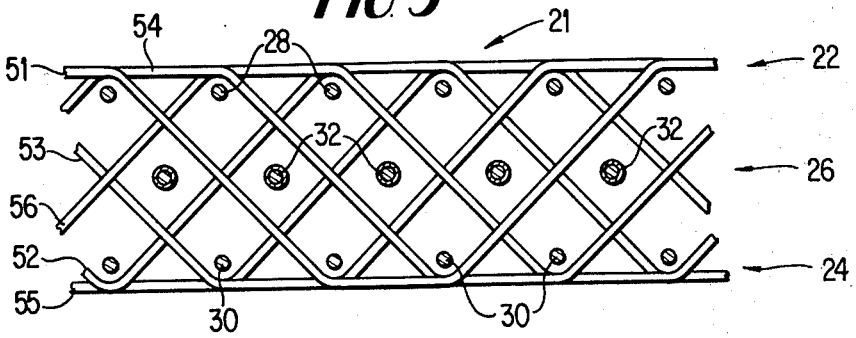
FIG. 3 is a longitudinal section of another duplex weave dryer felt employing the subject invention.

Another multi-layer weave, generally designated as 21, is illustrated in FIG. 3, wherein like numerals denote like elements. As can be seen here, like in FIG. 2, a dryer felt can be woven to have a desired face configuration, while at the same time employing the encapsulated stuffer yarns of the subject invention.

Figure 4:
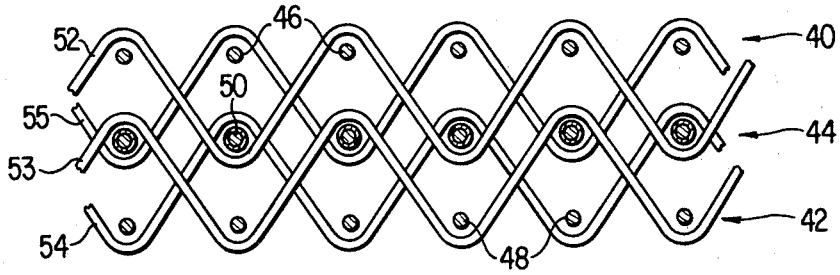
FIG. 4 is a longitudinal section of a triplex weave dryer felt employing the subject invention.

The subject invention may also be employed in a triplex weave dryer felt as illustrated in FIG. 4. A top plane or surface 40, which provides the face of the dryer felt, is defined by a plurality of cross machine direction yarns 46. The yarns 46 are made from a synthetic monofilament, a synthetic multifilament or spun fiber yarns. A bottom plane or surface 42, which provides the back of the dryer felt, is defined by a plurality of cross machine direction yarns 48. The yarns 48 are made from a synthetic monofilament, a synthetic multifilament or spun fiber yarns. An intermediate plane is defined by a plurality of encapsulated filling yarns 50. The yarns defining the various planes are united by a plurality of machine direction yarns 52 through 55, which are also made from a synthetic monofilament, a synthetic multifilament, or spun fiber yarns.

Obviously, many modifications and variations of the present invention are possible in light of the above teachings. It is, therefore, contemplated that the encapsulated yarns, used in the subject invention, may not replace all of the stuffer yarns or intermediate filling yarns in some dryer felts; and that the encapsulated yarns may be used to replace both stuffer yarns and intermediate filling yarns in other dryer felts. It is, therefore, to be understood that within the scope of the appended claims, the invention may be practiced otherwise than as specifically described.

What I claim is:

1. A dryer felt comprising: a plurality of machine direction and cross machine direction yarns interwoven to provide a multiple-plane fabric having at least a base plane, a top plane and an intermediate plane positioned between said base plane and said top plane; said base plane defined by a first plurality of said cross machine direction yarns; said top plane defined by a second plurality of said cross machine direction yarns; and said intermediate plane defined by a third plurality of said cross machine direction yarns, wherein a plurality of the yarns of said third plurality are encapsulated yarns so as to provide a soft, bulky intermediate plane, each of said encapsulated yarns comprising a straight, twistless monofilament core that has no turns about its axis per unit of length, and a sheath completely surrounding the full length of said core, said monofilament core being a bundle of filaments treated with a heat resistant resin.

2. The dryer felt according to claim 1, wherein all of the yarns of said third plurality are encapsulated yarns.

3. The dryer felt according to claim 1, wherein the yarns of said third plurality are stuffer yarns.

4. The dryer felt according to claim 1, wherein the yarns of said third plurality are filling yarns.

5. The dryer felt according to claim 1, wherein said sheath is made from a material chosen from the group consisting of asbestos, cotton, wool, synthetic fibers or aramid fibers.

6. The dryer felt according to claim 1, wherein said sheath is made from a material chosen from the group consisting of mineral fibers, natural fibers, and man-made fibers.

7. The dryer felt according to claim 1, wherein said monofilament core is made of wire.

8. The dryer felt according to claim 1, wherein said monofilament core is made from a treated glass fiber.

9. The dryer felt according to claim 1, wherein said resin is a phenolic resin.

10. The dryer felt according to claim 1, wherein the monofilament core is made from a material chosen from the group consisting of polyesters, polyamides, aramids, polyolefins, and acrylics.

11. The dryer felt according to claim 1, wherein said filaments are twistless so that each filament has no turns about its axis per unit of length.

12. A method of making a dryer felt having encapsulated, bulky center yarns, the method comprising the steps of: weaving a multiple-plane fabric having at least a base plane, a top plane and an intermediate plane positioned between said base plane and said top plane, said base plane being defined by a first plurality of cross machine direction yarns, said top plane being defined by a second plurality of cross machine direction yarns, and said intermediate plane being defined by a third plurality of cross machine direction yarns, wherein a plurality of the yarns of said third plurality are encapsulated yarns so as to provide a soft, bulky intermediate plane; and selecting encapsulated yarns each of which includes a straight, twistless monofilament core that has no turns about its axis per unit of length, and a sheath surrounding the full length of said core, said monofilament core being a bundle of filaments treated with a heat resistant resin.

13. The method according to claim 12, wherein the step of selecting encapsulated yarns further comprises selecting a monofilament core made from a synthetic material, and a sheath, made from a soft, bulky material, surrounding said monofilament core.

14. The method according to claim 13, further comprising the step of selecting said synthetic material for said monofilament core from the group consisting of polyesters, polyamides, aramids, polyolefins and acrylics.

15. The method according to claim 13, further comprising the step of selecting said soft, bulky material for said sheath from the group consisting of asbestos, cotton, wool, synthetic fibers, and aramid fibers.

16. The method according to claim 13, further comprising the step of selecting said soft, bulky material for said sheath from the group consisting of mineral fibers, natural fibers and man-made fibers.

17. A dryer felt having a face surface and a back surface, said dryer felt comprising: a machine direction and cross machine direction yarns interwoven in a binding relationship to provide a multiple-plane fabric having at least a base plane, a top plane and an intermediate plane positioned between said base plane and said top plane, said base plane being defined entirely by a first plurality of said cross machine direction yarns, said top plane being defined entirely by a second plurality of said cross machine direction yarns, and said intermediate plane being defined entirely by a third plurality of said cross machine direction yarns, only said third plurality being encapsulated yarns, each of said encapsulated yarns comprising a monofilamemt core and an encapsulating sheath surrounding the full length of said core, said sheath defining a soft, bulky outer surface which, when woven into said fabric, acts to prevent shifting of said encapsulated yarns in said fabric, wherein said encapsulated yarns reduce fabric permeability and add bulk to the fabric while contributing to fabric stability, said machine direction yarns being interwoven with said first plurality of cross machine yarns to define said back surface on said base plane and interwoven with said second plurality of cross machine direction yarns to define said face surface of said top plane.

18. The dryer felt of claim 17, wherein said monofilament core comprises a bundle of straight twistless filaments, each of said filaments having no turns about its axis per unit of length and being treated with a heat resistant resin to make the bundle act like a monofilament fiber.

19. The dryer felt of claim 17, wherein said monofilament core is straight and twistless in that it has no turns about its axis per unit of length.

20. The dryer felt according to claim 17, wherein the diameter of the monofilament core is in the range of about 5 to 50 mils.

21. The dryer felt according to claim 17, wherein the diameter of the monofilament core is in the range of about 15 to 35 mils.

22. The dryer felt according to claim 17, wherein the monofilament core is a material chosen from the group consisting of polyesters, polyamides, aramids, and acrylics.

23. A method of making a dryer felt having a face surface, a back surface, and encapsulated, bulky center yarns, the method comprising the steps of weaving a plurality of machine direction and cross machine direction yarns into a multiple-plane fabric to provide at least a base plane, a top plane and an intermediate plane positioned between said base plane and said top plane, said base plane being entirely defined by a first plurality of said cross machine direction yarns, said top plane being entirely defined by a second plurality of said cross machine direction yarns, and said intermediate plane being defined entirely by a third plurality of said cross machine direction yarns, only said third plurality being encapsulated yarns, each of said encapsulated yarns comprising a monofilament core and an encapsulating sheath surrounding the full length of said core, said sheath defining a soft, bulky outer surface which, when woven into said fabric, acts to prevent shifting of said encapsulated yarns in said fabric, wherein said encapsulated yarns reduce fabric permeability and add bulk to the fabric while contributing to fabric stability, said machine direction yarns being interwoven with said first plurality of cross machine yarns to define said back surface on said base plane and interwoven with said second plurality of cross machine direction yarns to define said face surface of said top plane.

24. The method of claim 23, further comprising the steps of making said monofilament core from a bundle of straight twistless filaments, each of said filaments having no turns about its axis per unit of length and treating said bundle with a heat resistant resin to make the bundle act like a monofilament fiber.

25. The method of claim 23, wherein said monofilament core is straight and twistless in that it has no turns about its axis per unit of length.

* * * * *